US006719672B1

(12) United States Patent
Ellis et al.

(10) Patent No.: US 6,719,672 B1
(45) Date of Patent: Apr. 13, 2004

(54) DUAL WEIGHT STACK EXERCISING MACHINE WITH COUPLING ARRANGEMENT

(75) Inventors: Patrick D. Ellis, Oak Creek, WI (US); Troy V. Waldron, Milwaukee, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 420 days.

(21) Appl. No.: 09/714,768

(22) Filed: Nov. 16, 2000

(51) Int. Cl.[7] ..... A63B 21/062
(52) U.S. Cl. ..... 482/99; 482/98
(58) Field of Search ..... 482/99, 93, 94, 482/97, 98, 100–103, 133, 148, 908

(56) References Cited

U.S. PATENT DOCUMENTS

| | | | |
|---|---|---|---|
| 4,540,171 A | 9/1985 | Clark et al. | |
| 4,712,793 A | 12/1987 | Harwick et al. | |
| 5,348,522 A | 9/1994 | Brotman | |
| 5,556,362 A | 9/1996 | Whipps | |
| 5,643,152 A | 7/1997 | Simonson | |
| 5,788,614 A | 8/1998 | Simonson | |
| 5,944,642 A | 8/1999 | Krull | |
| 6,436,013 B1 * | 8/2002 | Krull | 482/94 |
| 6,447,432 B1 * | 9/2002 | Krull | 482/98 |

* cited by examiner

*Primary Examiner*—Glenn E. Richman
(74) *Attorney, Agent, or Firm*—Andrus, Sceales, Starke & Sawall, LLP

(57) ABSTRACT

A weight stack adjusting mechanism is provided for an exercise machine having a frame, an operating mechanism movably connected to the frame, a resisting structure on the frame and a connecting device entrained about a first pulley and a second pulley. Both pulleys are mounted on the frame and join the operating mechanism with the resisting structure so as to selectively allow moving the resisting structure between a raised position and a lowered position. The system includes a first guide rod, a second guide rod, a third guide rod, and a fourth guide rod, each being supported by the frame. The resisting structure is formed by a primary weight stack movably mounted on the first and second guide rods, and a supplementary weight stack movably mounted on the third and fourth guide rods. A coupling arrangement is disposed upon a top plate of the primary weight stack and a top plate of the supplementary weight stack and interconnects the primary weight stack and supplementary weight stack together such that a lifting force applied through the connecting device will simultaneously lift the primary weight stack and the supplementary weight stack in a balanced manner.

7 Claims, 4 Drawing Sheets

DUAL WEIGHT STACK EXERCISING MACHINE WITH COUPLING ARRANGEMENT

FIELD OF THE INVENTION

The present invention relates generally to weight training exercise machines having a vertical stack of weights and, more particularly, pertains to an apparatus and method for adjusting resistance to an exercise motion incrementally in a balanced manner.

BACKGROUND OF THE INVENTION

So-called selectorized weight machines have been used in fitness clubs, gyms and athletic training facilities for many years. These machines allow the user to select the amount of weights on a weight stack which will be lifted during the exercise and training protocol. A particular version of a selectorized weight machine is one which allows for variable resistance along the range of motion of the exerciser training protocol. These selectorized, variable-resistance weight machines utilize an operating mechanism such as a cam having a varying radius or profile. Cable means of some kind, such as a wire cable, a chain, a belt, or the like is attached at one end of the cam, and is attached at the other end to the top of a selector bar passed through and connected to a weight stack. When the user rotates a force transmission means fixed to the cam, the cam rotates and winds up the cable, chain, etc., thereby lifting the weights from the weight stack along guide rods. The changing cam profile varies the mechanical advantage of the weights which the user encounters. The cam profile is designed to approximate the change in anatomical mechanical advantage of the user at each point in the range of motion.

Although exercise weight stacks are prevalent in the exercise industry, they nonetheless are subject to certain shortcomings. For example, in order to provide a sufficiently large amount of weight at a reasonable cost, equipment manufacturers generally use weight plates of relatively large mass. As a result, the weight being lifted cannot be adjusted in small increments.

Attempts have been made to remedy the need for incremental adjustment. For example, one known design depends upon a small weight stack connected to the end of the main weight stack. Another uses a system that allows the user to slide small weights onto a pin projecting from the front of the stack. However, both of these devices are deficient in maintaining the balance of the weight stack during use.

It is extremely important that the weight stack is raised by the cable or belt at the center of the top plate in the weight stack. If it is not, the plates will hang down on the heavy unbalanced end causing them to bind on the guide rods making operation of the machine rough. A related problem caused by an unbalanced weight stack is that over a period of time, the bushings in the top plate risers will wear, allowing the top plate to tip. If it tips enough, the selector bar in the center of the stack drags in the center holes of the plates that are not being lifted. It is likely with enough wear that the selector bar will miss the center holes in the plates not being lifted. With the lifted part of the stack not being balanced, a selector bar will strike the upper surface of the top plate or the top portion of the stack portion not being lifted causing the lifting portion of the stack to become jammed in a partially raised position. It has happened in the past, that not cognizant of the consequences, the exerciser on the machine would push the selector bar such that it would re-enter the center holes of the non-lifted portion of the stack, allowing the lifted portion of the stack to drop down on the exerciser's hand causing severe injury.

One weight stack exercise machine concerned with overcoming these problems is disclosed in co-pending U.S. patent application Ser. No. 09/527,000 filed Mar. 16, 2000 which is commonly assigned to the assignee of this application. In this disclosure, a weight stack adjusting system is provided for an exercise machine having a frame, an operating mechanism movably connected to the frame, a resisting structure on the frame and a connecting device entrained about a first pulley and a second pulley. Both pulleys are mounted on the frame and join the operating mechanism with the resisting structure so as to selectively allow moving the resisting structure between a raised position and a lowered position. The system includes a first guide rod, a second guide rod, a third guide rod, and a fourth guide rod, each being supported by the frame. The resisting structure is formed by a primary weight stack movably mounted on the first and second guide rods, and a supplementary weight stack movably mounted on the third and fourth guide rods. A main drive belt has a first end connected to the operating mechanism, an intermediate portion entrained about the first pulley so as to define a first vertical path tangent to the first pulley, and a second end joined to a center of the top plate of the primary weight stack. An auxiliary drive belt has a first end connected to the main drive belt at a junction forwardly of the first vertical path defined by the main drive belt, an intermediate portion wrapped around the second pulley so as to define a second vertical path tangent to the second pulley, and a second end secured to a center of a top plate of a supplementary weight stack. Although this exercise machine has performed generally satisfactorily, there have been a few problems experienced in the movement of the auxiliary drive belt. Additionally, not all exercise machines are designed to adapt the third pulley and the connected drive belt arrangements in their frames.

Not withstanding this prior art, it remains desirable to provide an improved weight stack exercise machine which enables the user to easily adjust the increment with which the weight or resistance can be increased or decreased. Likewise, it is also desirable to provide a multi-stack exercise machine in which each weight stack remains balanced so that jamming is prevented during the exercise motion. Additionally, it would be desirable to improve upon the weight exercise machine disclosed in the aforementioned co-pending patent application by eliminating the auxiliary drive belt and third pulley.

SUMMARY OF THE INVENTION

The invention advantageously provides dual weight stack exercise equipment which overcomes the disadvantages or drawbacks of the prior art. The weight stacks may be utilized with a variety of exercise apparatus to permit a user to vary weight employed by substantially any desired small increment. The invention has utility for those interested in maintaining health and fitness, as well as for those involved in physical therapy and rehabilitation from injury.

It is one object of the present invention to provide an exercise machine having structure for incrementally adjusting resistance to an exercise motion.

It is another object of the present invention to provide a balanced weight stack in an exercise machine which avoids jamming.

It is also an object of the present invention to provide a dual weight stack arrangement in an exercise machine which creates various levels of resistance.

It is a further object of the present invention to provide an exercise machine which minimizes injury to a user during use thereof.

It is an additional object of the present invention to provide a method of adjusting weight resistance in an exercise machine using a combination of side-by-side weight stacks.

Yet another object of the present invention is to provide a multi-stack exercise machine having a primary weight stack with one size of weights and a supplementary weight stack having a second and different size of weights.

A still further object of the present invention is to provide a variable resistance exercise machine which is simple in structure and easy to operate.

The invention contemplates a weight stack adjusting system for an exercise machine having a frame, an operating mechanism movably connected to the frame, resisting structure on the frame and a connecting device entrained about a first pulley and a second pulley, both being mounted on the frame and joining the operating mechanism with the resisting structure so as to selectively move the resisting structure between a raised position and a lowered position. The system includes a first guide rod, a second guide rod, a third guide rod and a fourth guide rod, each being supported by the frame. The resisting structure is formed by a primary weight stack having a plurality of plates including a top plate movably mounted on the first and second guide rods, and a supplementary weight stack having a plurality of plates including a top plate movably mounted on the third and fourth guide rods. The invention is improved wherein a coupling arrangement is disposed upon the primary weight stack top plate and the supplementary weight stack top plate, and interconnects the primary weight stack and the supplementary weight stack together such that a lifting force applied through the connecting device will simultaneously lift the primary weight stack and the supplementary weight stack in a balanced manner.

The coupling arrangement includes a force distribution assembly attached to the primary weight stack top plate and a carriage structure movably mounted on the second guide rod and the supplementary weight stack top plate. The force distribution assembly is connected between the first guide rod and the second guide rod and is disposed along the longitudinal centerline of the primary weight stack top plate. A drive belt has a first end connected to the operating mechanism, an intermediate portion entrained about the second pulley so as to define a first vertical path tangent to the second pulley, and a second end joined to a center of the top plate of the primary weight stack. The second end of the drive belt is joined to the center of the top plate of the primary weight stack by a cable clamp. The carriage structure includes a pair of spaced apart carriage plates, each of the carriage plates having a distal end supported on the cable clamp, and a proximal end pivotally connected to the top plate of the supplementary weight stack. A pair of rollers is rotatably mounted between the carriage plates, each of the rollers being slidably mounted for rolling movement along opposite sides of the second guide rod. The proximal ends of the carriage plates are interconnected by a horizontal member having a downwardly depending tab overlying an upwardly extending tab projecting from a collar located in the center of the top plate of the supplementary weight stack. The downwardly depending tab and the upwardly extending tab are pivotally joined together by a chain link. A first selector pin is engagable with plates of the primary weight stack, and a second selector pin is engagable with plates of the secondary weight stack. The force distribution assembly and the carriage structure include cylindrical tubes for retaining the first selector pin and the second selector pin. The supplementary weight stack is preferably located behind the primary weight stack.

The invention also contemplates a method of adjusting weight resistance in an exercise apparatus having a movable operating mechanism connected to a resisting structure by a connecting device entrained about a first pulley and a second pulley, each of which has an axis of rotation. The method includes the steps of providing a frame having a first guide rod, a second guide rod, a third guide rod and a fourth guide rod; and providing the resisting structure in the form of a stack of primary weights movably mounted on the first and second guide rods and a stack of supplementary weights movably mounted on the third and fourth guide rods. The invention is improved by providing a coupling arrangement which is disposed upon the primary weight stack top plate and the supplementary weight stack top plate and interconnects the primary weight stack and the supplementary weight stack together such that a lifting force supplied through the connecting means will simultaneously lift the primary weight stack and the supplementary weight stack in a balanced manner. The method includes the step of providing the connecting device in the form of a drive belt having a first end connected to the operating mechanism, an intermediate portion entrained about the second pulley so as to define a first vertical path tangent to the second pulley, and a second end joined to a center of a top plate of a primary weight stack. The method further includes the step of locating the supplementary weight stack behind the primary weight stack. The method also includes the step of providing a first selector arrangement for the primary weight stack and a second selector arrangement for the supplementary weight stack whereby a user of the exercise machine uses at least one of the selector arrangements to define the resisting structure for the operating mechanism.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The present invention is an improvement of the exercise machine set forth in co-pending U.S. patent application Ser. No. 09/527,000 filed Mar. 16, 2000, the disclosure of which is herein incorporated by reference.

Figure 1:
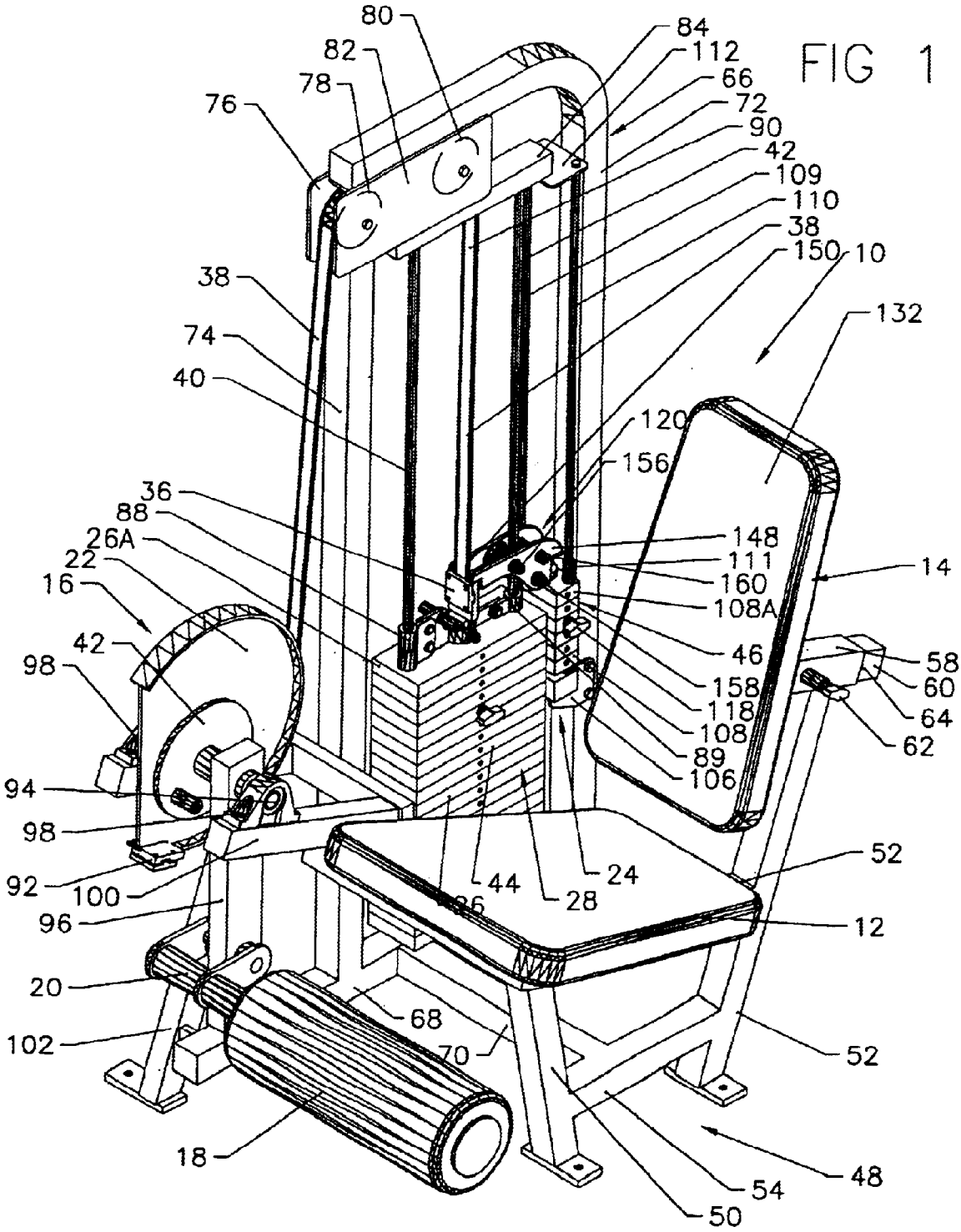
FIG. 1 is an isometric view of a weight stack exercise machine incorporating a system and method for adjusting weight resistance in accordance with the invention, showing a primary weight stack and a supplementary weight stack connected with an operating mechanism at rest.
Figure 2:
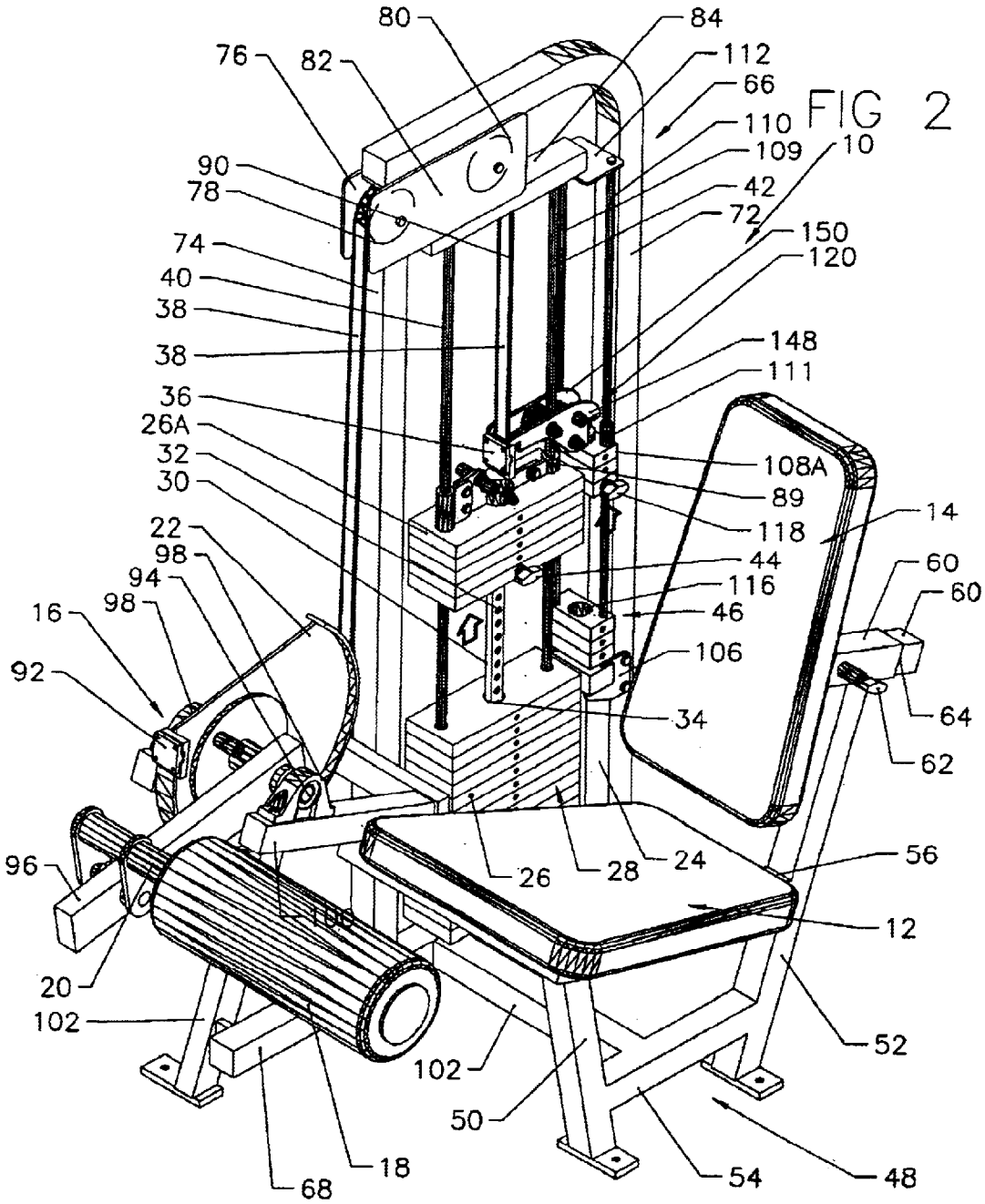
FIG. 2 is a view like FIG. 1, but showing the operating mechanism activated so as to lift weights of the primary weight stack and supplementary weight stack.

Referring now to the drawings, the present invention as shown embodied in a weight stack leg extension exercise machine indicated generally by the reference numeral 10. The machine 10 is configured for a human user to exercise by sitting forwardly in an adjustable seat having a seat bottom 12 and an adjustable back rest 14. An operating mechanism 16 including a cylindrical pad 18 mounted on a shaft 20 and a cam 22 is swingably mounted relative to the seat bottom 12. Exercise is achieved by placing at least one foot under the pad 18 while seated and extending the leg (s) from an at rest or lowered position shown in FIG. 1 to an actuated or raised position shown in FIG. 2. During such movement, the user applies a moving force to the operating mechanism 16 to overcome a loading force applied thereto by a resisting structure 24. As is well known, the resisting structure 24 includes a set of generally rectangular weight plates 26 of equal size arranged in a primary vertical stack 28. As seen in FIG. 2, a main selector bar 30 has a series of spaced apart apertures 32 formed therein and passes through aligned central openings 34 in the weight plates 26. The main selector bar 30 is operably connected by a cable clamp 36 at its upper end to a drive belt 38. The drive belt 38 lifts the bar 30 and any weight plates 26 attach thereto along a pair of parallel first and second guide rods 40, 42, respectively, in response to movement of the operating mechanism 16 which is connected through a pulley arrangement to the drive belt 38. The amount of weight in the primary weight stack 28 lifted by the user depends upon the number of weight plates 26 which are connected to selector bar 30. The weight plates 26 are generally arranged and fixed, for example, in 10, 12 or 20 pound increments, and a first removable pin 44 is provided which must be manually repositioned in a desired selector bar aperture 32 by the user to pin a selected one or more of the weights 26 to the selector bar 30 for movement therewith. Of course, each of the weights 26 positioned above the weight pinned to the selector bar 30 is also lifted with the bar.

The fixed increment of the weight plates 26 and primary stack 28 may be too excessive for some individuals or for certain work-out routines. For example, athletes in certain exercise routines may want to perform successive repetitions of exercise quickly increasing or decreasing the weight in different increments from a lighter to a heavier weight or vice versa. Similarly, persons using weights in physical therapy to recover from an injury may desire to increase the weight more gradually to obtain optimal benefits of the therapy. For this purpose and, in accordance with the present invention, the operating mechanism 16 coupled to the primary weight stack 28 is also operably connected with a supplementary weight stack 46 mounted separately from and adjacent to the primary weight stack 28. The machine 10 is also designed in a manner which will ensure smooth motion in lifting and lowering of weights and prevent binding or jamming, as will be further described below.

It is noted that while the exercise machine 10 is disclosed in terms of the lower body machine where the user's legs are utilized to move and resist movement of the operating mechanism 16, the present invention is equally applicable to machines where the user sits in the seat and uses arms or the upper body to resist a type of movement where the user achieves exercise by lifting, pulling or pushing some type of coupling member to apply a moving or resisting force thereto.

In the description to follow, references to the terms "front", "forward", "back", "rear", "left", "right", "upper", "up", "lower", "top", and "bottom" are to be taken from the perspective of an exerciser seated with his/her back against the rest 14. As shown in FIGS. 1 and 2, the exercise machine 10 includes a floor-engaging frame 48 constructed of a series of heavy duty tubular steel sections which are welded together. In particular, frame 48 is comprised of an angular front leg 50, an angular rear leg 52, a lower cross member 54 and an upper angular cross member 56 oriented so as to mount declined seat bottom 12 thereon. The upper end of the rear leg 52 is provided with a tubular sleeve 58 for slidably receiving a mating tongue 60 projecting from the rear portion of back rest 14. The sleeve 58 carries a positioning pin 62 which enables fore and aft adjustability of the backrest 14 relative to the seat 12. Appropriately aligned openings 64 formed in the tongue 60 receive the positioning pin 62 so the backrest 14 can be positioned at a desired reclined position according to the particular size of the exerciser. The seat 12 and backrest 14 provide a user support adapted to maintain the exerciser in a comfortable sedentary position. Spaced laterally from the seat and backrest structure is a weight stack rack 66.

Rack 66 has a horizontal base member 68 interconnected with lower cross member 54 by a transverse beam 70. Extending upwardly from base member 68 is a rear upright 72 which runs substantially vertically and curves forwardly at its top end, and a front upright 74 which runs vertically and terminates short of the front end of the rear upright 72. At the top, front end of the rack 66 is a generally rectangular, mounting plate 76 which extends between the curved portion of the rear upright 72 and the upper end of the front upright 74. The mounting plate 76 serves as an attachment surface for a pair of first and second pulleys 78, 80, respectively, which are rotatably journaled thereto. The pulley 78, 80 are positioned such that their axes of rotation are substantially parallel to each other, and such that they are interposed between the mounting plate 76 and a cover plate 82. A connector bar 84 provides a passageway for drive belt 38, is fixed to the bottom of mounting plate 76 and accommodates the top ends of the first and second guide rods 40, 42, respectively, which extend through the plates 26 of the primary weight stack 28 to base member 68. The guide rods, 40, 42 pass through bearings internally mounted within a pair of cylindrical risers 88, 89 projecting upwardly and lying substantially along the longitudinal centerline of the top plate 26a and primary weight stack 28.

As partially described above, drive belt 38 has one end connected to the top plate 26*a* of primary weight stack, an intermediate portion 90 wrapped around the pulleys 40, 42 and an opposite end 92 connected to operating mechanism 16. With the weight plates 26 in their lowered position, the intermediate portion 90 of the drive belt 38 defines a first vertical path tangent to the pulley 80. In the preferred embodiment, the operating mechanism 16 takes the form of a cam 22 which is rotatably mounted on a shaft 94 which passes through the top end of a swingable lever arm 96. The shaft 94 is mounted in pillow block bearings 98 on opposite ends of a U-shaped bracket 100. An angular brace 102 has a lower end secured to the front end of the base member 68 and an upper end to which the bracket 100 is fixed. A lower end of the lever arm 96 is provided with stationary shaft 20 on which the foot-engaging cylindrical pad 18 is connected. As is known, when a user moves a pad 18 upwardly (FIG. 2), a cam 22 rotates and winds up the drive belt 38 on its periphery thereby lifting the primary weight stack 28. The changing cam profile varies the mechanical advantage of the weights the user encounters. The cam profile is designed to approximate a changing anatomical mechanical advantage of the user at each point in the range of motion. Ideally when the user is at a weak point, the cam profile will match the weakness by minimizing the mechanical advantage which the primary weight stack 28 has on the user. Similarly, the cam profile is designed to modify the mechanical advantage of the weight stack in an appropriate fashion when the user is at a strong point in the anatomical range of motion. In this case, the cam profile will maintain the mechanical advantage that the weight stack 28 has on the user. The varying radius of the cam profile is an attempt to approximate an ideal situation where the user is lifting as much as he or she can at each point in the range of motion.

The rear upright 72 of rack 66 includes a bracket 106 for supporting the supplementary weight stack 46 between the primary weight stack 28 and the rear upright 72. The supplementary weight stack 46 forms part of the resisting structure 24 and includes a vertical array of weight plates 108 movable along a third guide rod 109 and fourth guide rod 10 extending from the bottom through respective risers 111 (only one of which is seen in the drawings), to the top plate 108*a* in stack 46 and fixed, for example, in two pound increments. A plate 112 is secured to connector bar 84 and serves to fix the upper ends of the guide rods 109, 110, respectively, extending from the supplementary weight stack 46. Like the primary weight stack 28, a supplementary selector bar 113 (FIG. 4) has a series of spaced apart apertures 114 formed therein and passes through aligned central openings 116 (FIG. 2) in the weight plates 108. A second removable pin 118 is provided which is manually re-positioned in a desired selector bar aperture 114 by the user to pin a selected one or more of the supplementary weights 108 to the selector bar 113 for movement therewith. With this above-described structure, the user of the machine 10 can vary the weight of the resistance in any number of combinations simply by setting each of the pins 44, 118, respectively, in desired locations and respective weight stacks 28, 46.

In accordance with the present invention, the primary weight stack 28 and the supplementary weight stack 46 are interconnected together by a coupling arrangement 120 in a manner such that the weight stacks 28, 46 will remain balanced no matter how many weight plates 26, 108 are lifted.

Figure 3:
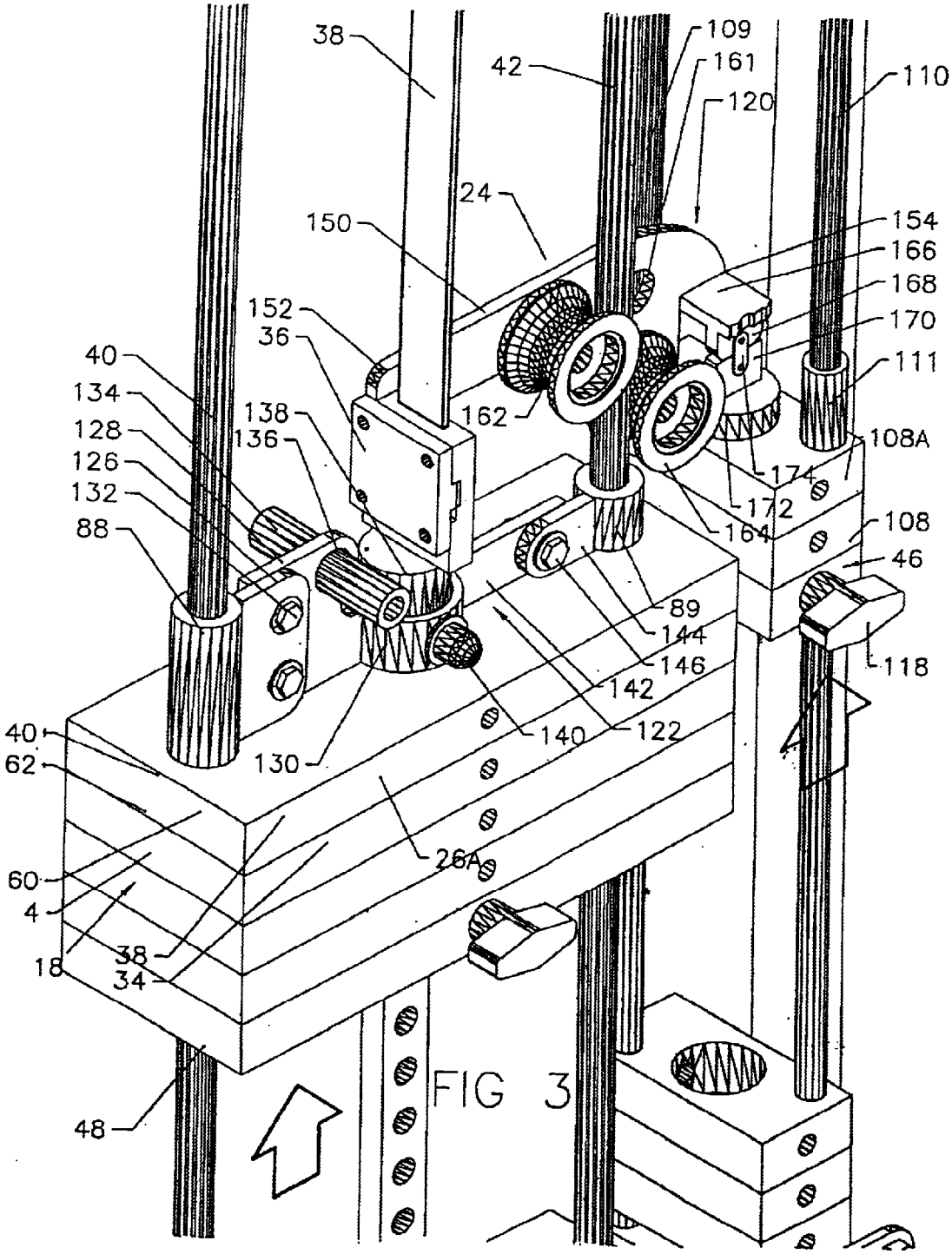
FIG. 3 is an enlarged, fragmentary, isometric view showing a coupling arrangement for joining the primary weight stack and the supplementary weight stack.
Figure 4:
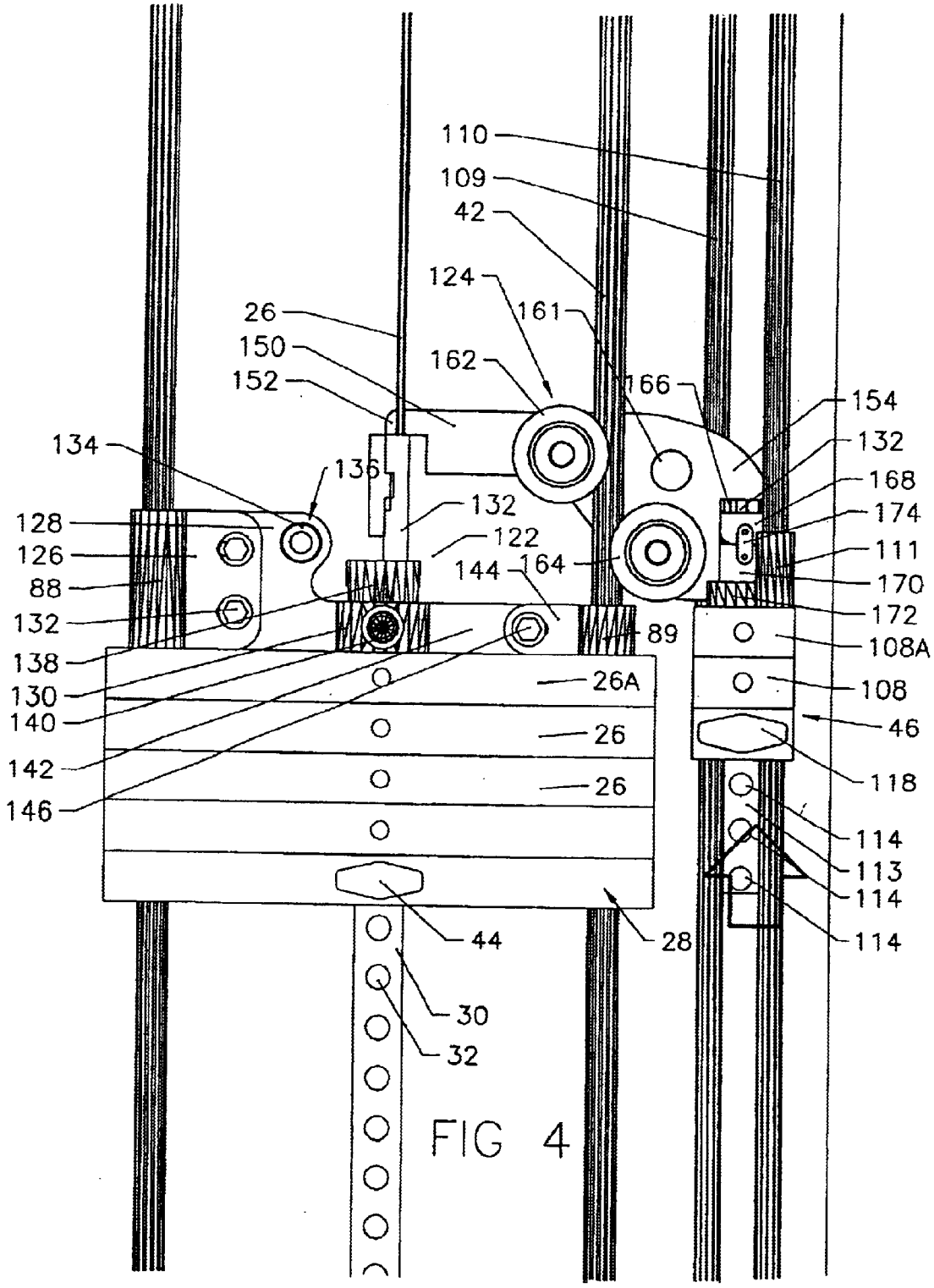
FIG. 4 is an enlarged, elevational view similar to FIG. 3.

Referring now to FIGS. 3 and 4, coupling arrangement 20 is comprised of a force distribution assembly 122 and a carrier structure 124. Force distribution assembly 122 is disposed upon and along the longitudinal centerline of top plate 26*a* of primary weight stack 28 between the risers 88, 89 and their respective guide rods 40, 42. Carriage structure 124 extends between the cable clamp 36 and the top plate 108*a* of the supplementary weight stack 46.

Force distribution assembly 122 includes a first laterally extending ear 126 joined to riser 88 in overlapping relationship with a second laterally extending ear 128 secured to a cylindrical collar 130 disposed in the middle of top plate 26. A pair of vertically aligned fasteners 132 extend through aligned holes in the overlapping ears 126, 128 to hold same together. A first elongated cylindrical tube 134 is retained within an opening 136 formed in the ear 128 and functions to hold the pin 44 when minimal weight in the stack 28 is being lifted. The collar 130 is provided with a suitable opening (not shown) for receiving selector bar 30 which depends from a reduced diameter, cylindrical collar 138 mounted upon the collar 130 and fixed to the bottom of cable clamp 36. A fastener 140 is passed through a hole formed in the collar 130 and aligned with the uppermost aperture 32 in selector bar 30. Secured to the other side of collar 130 is a laterally extending horizontal bar 142 which lies in overlapping relationship to another laterally extending ear 144 anchored to riser 89. A single fastener 146 extends through aligned holes formed in the bar 142 and ear 144 and serves to retain the two components together.

Carriage structure 124 includes spaced apart, front and rear carriage plates 148, 150 (FIGS. 1 and 2), each having a distal end 152 which rests upon the upper end of cable clamp 36 and a proximal end 154 which is supported on top plate 108*a* of supplementary weight stack 46. Plates 150, 152 are held together by appropriate fasteners 156, 158 (FIG. 1). A second elongated cylindrical tube 160 extends between the plates 150, 152 in aligned holes 161 (one being seen in FIGS. 3 and 4) and acts to hold pin 118 when minimal weight in stack 46 is lifted. Fasteners 156, 158 are also utilized to rotably mount a pair of offset, conical rollers 162, 164 between the plates 148, 150. Rollers 162, 164 are located such that they engage opposite sides of guide rod 42 and slide therealong when the plates 26, 108 of respective weight stacks 28, 46 are lifted. As best seen in FIG. 3, the rollers 162, 164 are grooved with a smooth, rounded contour so that they will permit a slight amount of rotational shifting about the longitudinal axis of the guide rod 42 during lifting of the weight stacks 28, 46. The proximal ends 154 of the plates 150, 152 are interconnected by a horizontal member 166 having a depending tab 168. The tab 168 overlays an upwardly projecting tab 170 lying perpendicularly to the upper surface of the cylindrical collar 172 which is centered along the longitudinal center of the top plate 108*a*. A chain link 174 has an upper end pivotally secured to tab 168 and a lower end pivotally secured to tab 170. The chain link 174 advantageously permits the carriage structure 124 to pivot about a horizontal axis as the supplementary weight stack 46 is lifted.

In use, when the user of the leg extension machine 10 is ready to exercise, the user positioned on seat 12 reaches to the right and manually positions the pins 44, 118 in the desired locations in respective weight stacks 28, 46. In the following example, assume the plates 26 in primary weight stack 28 each weigh 10 pounds and the plates 108 in supplementary weight stack 46 each weigh two pounds. As shown in FIGS. 2, 3 and 4, the user setting the pins 44, 118 wishes to lift 56 pounds in weight plates. When the user lifts the pad 118 upwardly, the cam 22 rotates and winds up the drive belt 38 on its periphery, thereby lifting the primary weight stack 28. It is important to note that the drive belt 38 is connected with cable clamp 36, and collars 130, 138 to the center of the top plate 26*a*. It is likewise important to realize that the coupling arrangement 120 extending between cable clamp 36 and top plate 108*a* enables the lifting force through drive belt 38 to be transferred to the center of top plate 108*a* so that both primary weight stack 28 and supplementary weight stack 46 are simultaneously lifted in a balanced manner no matter how many weight plates 26, 108 are lifted. Force distribution assembly 122 helps to distribute the lifting force applied through belt 38 along the longitudinal centerline of the top plate 26*a* to establish stability in the primary weight stack 28. As weight plates 26 move upwardly so to does coupling arrangement 120 with rollers 162, 164 between carriage plates 148, 150 smoothly sliding along guide rod 42 and the proximal ends 154 being connected to the top plate 108*a* of supplementary weight stack 46. As mentioned above, the rollers 162, 164 are shaped to permit a slight rotational shifting of the coupling arrangement 120 about the longitudinal axis of guide rod 42. In addition, the chain link 174 allows a limited amount of pivotal movement about a horizontal axis so that there is no binding of the guide rods 109, 110 and no undue wear on risers 111. Force distribution assembly 122 further prevents binding of guide rods 40, 42 and undue wear to risers 88, 89. With the coupling arrangement 120, the weight stacks 28, 46 will remain balanced so that jamming is prevented during exercise motion. Without the coupling arrangement, the selector bar (s) 30 or 112 will drag against the walls of the aligned openings 34, 116 in the plates not being lifted. If either stack becomes unbalanced, is likely that with enough wear, the selector bar (s) 30 or 112 will strike the top surface of the top plate of the stack portion not lifted causing the lifted portion to become jammed in a partially raised position. With this condition, the user may push the selector bar 30 or 112 back into the aligned holes in the unlifted portion of the stack allowing the lifted portion of the stack to drop down on the exerciser's hand or arm causing injury. The present invention anticipates this problem without having to employ a separate pulley and drive belt for the supplementary weight stack 46.

Thus, it can be appreciated that the present invention provides an incrementally adjustable, dual weight stack arrangement in an exercise machine which creates various levels of resistance simply by positioning the pins in their respective selector bars. In the preferred embodiment, the pin adjustment can be conveniently made while the exerciser sits in the seat. Unlike the prior art, there are no removable weights, no loose weights to manipulate and no loose weights to attach in the exercise apparatus. The present invention also provides balanced weight stacks which will eliminate jamming or binding and maintain a smooth operation without causing injury in the use thereof.

While the invention has been described with reference with a preferred embodiment, those skilled in the art will appreciate that certain substitutions, alternations and omissions may be made without departing from the spirit thereof Accordingly, the foregoing description is meant to be exemplary only and should not be deemed imitative on the scope of the invention set forth in the following claims.

We claim:

1. In a weight stack adjusting system for an exercise machine having a frame, an operating mechanism movably connected to the frame, resisting structure on the frame and connecting means entrained about a first pulley and a second pulley, both being mounted on the frame and joining the operating mechanism with the resisting structure so as to selectively allow moving the resisting structure between a raised position and a lowered position, the system including a first guide rod, a second guide rod, a third guide rod, and a fourth guide rod, each being supported by the frame, and the resisting structure being formed by a primary weight stack having a plurality of plates including a top plate movably mounted on the first and second guide rods and a supplementary weight stack having a plurality of weight plates including a top plate movably mounted on the third and fourth guide rods, the improvement comprising:

a coupling arrangement disposed upon the primary weight stack top plate and the supplementary weight stack top plate and interconnecting the primary weight stack and the supplementary weight stack together such that a lifting force applied through the connecting means will simultaneously lift the primary weight stack and the supplementary weight stack in a balanced manner, wherein the coupling arrangement includes a force distribution assembly attached to the primary weight stack top plate, and a carriage structure movably mounted on the second guide rod and the supplementary weight stack top plate, a drive belt having a first end connected to the operating mechanism, an intermediate portion entrained about the second pulley so as to define a first vertical path tangent to the second pulley, and a second end joined to a center of the top plate of the primary weight stack wherein the second end of the drive belt is joined to the center of the top plate of the primary weight stack by a cable clamp, wherein the carriage structure includes a pair of spaced apart, carriage plates, each of the carriage plates having a distal end supported on the cable clamp and a proximal end pivotally connected to the top plate of the supplementary weight stack, and wherein the proximal ends of the carriage plates are interconnected by a horizontal member having a downwardly depending tab overlying an upwardly extending tab projecting from a collar located in the center of the top plate of the supplementary weight stack.

2. The improvement of claim 1, including a pair of rollers rotatably mounted between the carriage plates, each of the rollers being mounted for rolling movement along opposite sides of the second guide rod.

3. The improvement of claim 1, wherein the downwardly depending tab and the upwardly extending tab are pivotally joined together by a non-rigid connection.

4. The improvement of claim 1, including a first selector pin engagable with plates of the primary weight stack, and a second selector pin engagable with plates of the supplementary weight stack.

5. The improvement of claim 4, wherein the force distribution assembly and the carriage structure include cylindrical tubes for retaining the first selector pin and the second selector pin.

6. The improvement of claim 1, wherein the supplementary weight stack is located behind the primary weight stack.

7. The improvement of claim 1, wherein the force distribution assembly is connected between the first guide rod and the second guide rod, and is disposed along the longitudinal centerline of the primary weight stack top plate.

* * * * *